United States Patent [19]

Beck et al.

[11] Patent Number: 4,842,700

[45] Date of Patent: Jun. 27, 1989

[54] PREPARATION OF ω-HYDROXYALDEHYDES OR CYCLIC HEMIACETALS THEREOF

[75] Inventors: Fritz Beck, Duisburg; Bernd Wermeckes, Muelheim/Ruhr, both of Fed. Rep. of Germany; Harry Schulz, Baden, Switzerland

[73] Assignee: BASF Aktiengesellschaft, Ludwigshafen, Fed. Rep. of Germany

[21] Appl. No.: 47,177

[22] Filed: May 7, 1987

[30] Foreign Application Priority Data

May 7, 1986 [DE] Fed. Rep. of Germany ..... 3615472

[51] Int. Cl.[4] ..... C25B 3/02

[52] U.S. Cl. ..... 204/59 R; 204/78; 204/79; 204/80

[58] Field of Search ..... 204/59 R, 78, 79, 80

[56] References Cited

U.S. PATENT DOCUMENTS 4,354,904 10/1982 Malloy ..... 204/59 R
4,482,438 11/1984 Ballard ..... 204/78

FOREIGN PATENT DOCUMENTS 129802 2/1985 European Pat. Off. .
590310 7/1947 United Kingdom .

OTHER PUBLICATIONS

Horanyi et al., "Electrocatalytic Oxidation of Tetrahydrofuran at a Platinized Platinum Electrode in Aqueous Acidic Medium," Electrochimica Acta, vol. 30, pp. 767-772 (1985).

Horanyi et al., "Reductive Cleavage of C—OH Bonds in Allyl Position-Formation of Gaseous Products in the Course of the Cathodic Reduction of Some Simple Unsaturated Alcohols", Electroanal. Chem, v 101, p. 102 (1979).

Angew. Chem. 70 (1958) p. 211.

Bull. Soc. Chim. France, Memoires Presentes a la Societe Chimique (1950) p. 668.

Horanyi et al, Electrochimica Acta, vol. 30, No. 6, pp. 767-772, (1985).

Chem. Abstracts, vol. 82 (1975), p. 388, No. 97398q.

*Primary Examiner*—John F. Nielbing
*Assistant Examiner*—Isabelle Rodriguez
*Attorney, Agent, or Firm*—John H. Shurtleff

[57] ABSTRACT

Cyclic hemiacetals thereof of the formula

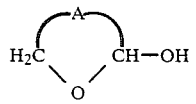

where A is saturated hydrocarbyl of 2 to 16 carbon atoms which may contain —O— as a bridge member are prepared by subjecting cyclic ethers of the formula

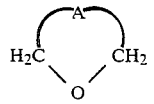

where A has the abovementioned meaning, to anodic oxidation in aqueous solution at current densities of over 30 $mAcm^{-2}$.

11 Claims, No Drawings

PREPARATION OF ω-HYDROXYALDEHYDES OR CYCLIC HEMIACETALS THEREOF

The present invention relates to a process for preparing cyclic hemiacetals thereof by anodic oxidation of cyclic ethers.

ω-hydroxyaldehydes, which are α,ω-bifunctional compounds, are useful intermediates. In the case of ω-hydroxybutanal and ω-hydroxypentanal, these compounds easily form the cyclic hemiacetals, namely α-hydroxytetrahydrofuran (THF—OH) and α-hydroxytetrahydropyran respectively. While, for example, β-hydroxyaldehydes are readily accessible by aldol condensation, ω-hydroxyaldehydes are less simple to prepare. THF—OH, for example, is obtained by chemical oxidation of tetrahydrofuran (THF) with an aryldiazonium salt:

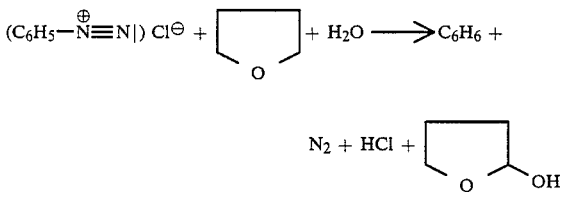

However, the yields with this process, described in Angew. Chem. 70 (1958), 211, are low. On repeating this work, we found that little THF-OH is formed in addition to a lot of butyrolactone (BL) as well as succinic acid (SA). THF—OH can also be prepared by hydration of 2,3-dihydrofuran (Bull. Soc. Chim. Fr. 1950, 668):

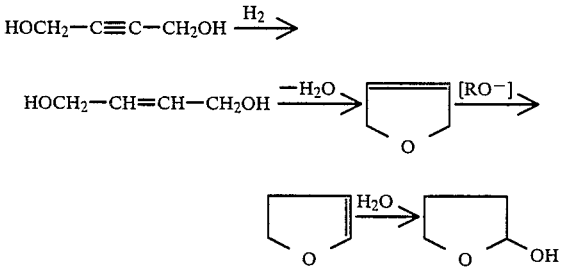

We found that the last stage gives a 60% yield.

EP-B-129,802 describes an Rh-complex-catalyzed hydroformylation of allyl alcohol $$CH_2=CH-CH_2OH+H_2+CO\rightarrow CHO-(CH_2)_3-OH,$$

where, in addition to the desired product (79% selectivity), several byproducts are obtained.

We have now found, surprisingly, that an a cyclic hemiacetal (II) thereof of the formula

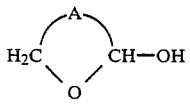

where A is saturated hydrocarbyl of 2 to 16 carbon atoms with or without —O— as a bridge member, can be prepared in high selectivity by subjecting a cyclic ether of the formula

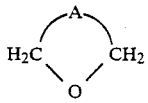

where A has the abovementioned meaning, to anodic oxidation in aqueous solution at current densities of over 30 $mAcm^{-2}$.

In the case of tetrahydrofuran (THF), the electrochemical process can be written as follows:

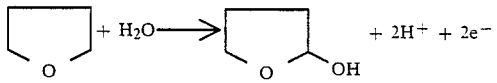

Suitable starting materials of the formula III are for example THF, tetrahydropyran or 1,4-dioxane.

The cyclic ethers of the formula III are used in the electrolysis in the form of their aqueous solutions. The electrolyte solutions preferably contain acids having anodically stable anions, in particular sulfuric acid or phosphoric acid. If the cyclic ether has a relatively high number of carbons, cosolvents, for example methanol or acetonitrile, are added in concentrations of from 10 to 80% by weight. Additionally or independently thereof, the starting material can be present in the electrolyte as an emulsion.

Expediently the electrolyte used is a 0.1—0.5M, in particular a 0.5–2M, aqueous solution of one of the acids mentioned. However, in place of the acids the electrolytes can also contain buffer substances to keep the electrolyte at pH 0–6. It is also possible to add conventional conducting salts, such as sodium sulfate. The cyclic starting materials are present in the electrolyte in about 1–6 $mol/dm^3$.

The cathodes are made of material customary for electrolysis, such as steel, stainless steel, graphite, graphite-filled plastic or copper. Particularly suitable anode materials are the platinum metals or oxides thereof. Preference is given to smooth platinum, for example in the form of a plate or composite electrode. In principle, graphite and glass/carbon are also usable anode materials.

In batchwise electrolysis, the conversion of the cyclic ether is expediently kept within the range from 10 to 80%, preferably from 20 to 60%. However, it is also possible to electrolyse with higher conversions, since for example THF and THF—OH are easily separated by distillation. The electrolysis is carried out for example at from 0° to 50° C., preferably at from 30° to 40° C.

The current densities employed in the electrolysis are above 30 $mAcm^{-2}$, and range for example from over 30 to 1,000, preferably from 100 to 300, $mAcm^{-2}$. The current densities relate to the true surface area, and in the case of smooth platinum are thus virtually identical with the current density expressed in terms of the geometric surface area. The fact that current yields increase with increasing current densities is a welcome effect in the light of the high platinum costs.

The electrolyte is agitated by forced convection, for example by stirring, pumping or vibrating. However, since a little oxygen is also always formed at the anode, highly effective convection already exists for that reason alone. The electrolysis is preferably carried out in divided cells or quasi-divided cells as described in Chem. Ber. 118 (1985), 3771-3779, in order to avoid reduction of the aldehyde group. However, it is also possible to work in undivided cells, provided cathodes having a small hydrogen overvoltage are used.

The process according to the invention produces for example THF—OH from THF in high selectivity. This advantageous result was not foreseeable, since the existing electrolytic oxidation of THF, which is described for example in British Pat. No. 590,310 and where current densities of 10 $mAcm^{-2}$ are employed, gives succinic acid.

EXAMPLE 1

The electrolysis cell used comprised a cylindrical 400 ml capacity glass vessel with cooling jacket and flat flange lid, which was equipped with an internal thermometer and a reflux condenser. The anode, which comprised a sheet of smooth platinum measuring 50×50×0.1 mm, ie. having a surface area of 50 $cm^2$ (both sides together) was arranged in the center between two V2A wire cathodes (1.5 mm ID). The spacings between sheet anode and wire cathode were in each case 1.5 cm. The electrolyte was stirred magnetically.

The cell was charged with 200 ml of an aqueous electrolyte of 1M strength with respect to THF and of 1M strength with respect to $H_2SO_4$. Electrolysis was carried out with a current of 10.0 A, corresponding to an anode current density of 200 $mAcm^{-2}$. The electrolyte temperature was maintained at 35° C. by water cooling. The cell voltage was 6.5 V. The electrolysis gases left the cell through a brine-cooled reflux condenser. Discharged THF was made up by replenishing with fresh THF (constant electrolyte volume). After 38.6 minutes, corresponding to 6.43 Ah or a theoretical current conversion (2 F/mol of THF) of 60%, the electrolysis was discontinued. After cooling down to 20° C. a 1 ml sample of the electrolyte was analyzed by HPLC after 1:5 dilution with the eluent (aqueous $H_2SO_4$; pH 1.7).

Analysis of the HPLC diagram, which can be seen in Table 1, reveals that THF—OH was formed as the dominant product in addition to a little butyrolactone (BL) and the hydrolysis product thereof, namely ω-hydroxybutyric acid. The first two peaks are of unknown origin.

TABLE 1

| Retention time [min] | Product | Area % | Conc/M as per calibration curve | n mmol |
|---|---|---|---|---|
| 8.16 | ? | 2.7 | ? | ? |
| 9.41 | ? | 0.54 | ? | ? |
| 11.48 | Bu—OH* | | | |
| 21.67 | BL | 2.6 | 0.008 | 1.6 |
| 15.58 | THF—OH | 94.1 | 0.404 | 80.8 |

*ω-hydroxybutyric acid

The abovementioned amount of electric charge (6.43 Ah) would have produced 120 mmol of THF—OH if the current yield had been 100%. The observed 80.8 mmol thus correspond to a current yield of 67.3%. Furthermore, theoretically 60 mmol of BL would have been formed in the case of a 100% current yield. The observed amount (1.6 mmol) thus corresponds to a 2.7% current yield.

The unconverted THF was likewise analyzed by HPLC, except that a ¼ V/V methanol/water mixture was used as eluent (2 ml $min^{-1}$). 108 mmol of unconverted THF were recovered, ie. 92 mmol of THF were thus converted. The material yields were thus 88% (THF—OH) and 1.7% (BL).

To work up the electrolyzed mixture, an extraction with ether was performed for 12.5 h in a continuous extractor (perforator). The ether extract (about 200 ml) was stirred with 15 ml of saturated aqueous $K_2CO_3$ solution, dried with anhydrous $Na_2SO_4$ and evaporated in a rotary evaporator under a waterjet vacuum. This left 6.3 g of crude product. 822 mg of the crude product were made up to 10 ml in 1M $H_2SO_4$; 1 ml thereof was diluted with 5 ml of eluent (about 0.01M $H_2SO_4$ of pH 1.7) and subjected to HPLC analysis, which revealed a THF—OH concentration of 0.84M. This corresponds to a molar amount of 64.4 mmol of THF—OH, and to a current yield of 54% for the extracted product.

The crude product was distilled under reduced pressure (1.5 mm Hg). To stabilize the crude product, a little 85% strength phosphoric acid or cationic exchange membrane pieces in the $H^+$ form were added. The boiling point ranged from 24° to 30° C. (2 mm Hg).

Gas chromatography analysis of the crude product in ether (capillary column, 10 m, polar stationary phase, 100° C., He, 25 ml/min) produced 5 peaks (retention times in minutes):

(1) 0.69+++
(2) 0.90+(BL)
(3) 3.01++
(4) 3.23 (+)
(5) 3.56++

The four unknown peaks are probably oligoacetals which are formed in the column. In the presence of acid traces in the ether solution, the 1st peak increases significantly at the expense of the others (3,4,5).

GC—MS coupling likewise identified corresponding products of mass $(88)_n$ where n=1-5. A further portion of the crude product was reacted with an approximately 5 times molar excess of 2,4-dinitrophenylhydrazine in 2N HCL. The yellow 2,4-dinitrophenylhydrazone was formed in a material yield of 90%, based on the THF—OH content, and had a melting point of 117.6° C.

| | Elemental analysis revealed: | |
|---|---|---|
| | found % | calculated % |
| C | 44.97 | 44.78 |
| H | 4.47 | 4.48 |
| N | 20.95 | 20.90 |

Another portion, namely 1.0 g, of the crude product was dissolved in t-butanol and reacted with a concentrated aqueous $NH_2OH.HCl$ solution. Removal of the solvent by distillation and extraction with ether followed by stripping of the ether left THF—OH in the form of a colorless oil (0.61 g) having a refractive index of $n_D$21.5° C.≧1.4608. The NMR spectrum of the product gave the following values:

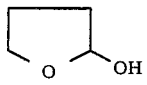

The loss of platinum which was observed at the anode after the experiment amounted to 0.26 mg, corresponding to a specific amount of 0.04 mg/Ah.

EXAMPLE 2

In the cell of Example 1, 200 ml of an aqueous electrolyte which was 4M in strength with respect to THF and 1M in strength with respect to $H_2SO_4$ were reacted at 75 mA $cm^{-2}$, corresponding to 3.75 A, and 35° C. over smooth platinum. The cell voltage was on average 4.7 V. After 6 hours and 54 minutes, corresponding to a theoretical current conversion of 60%, the electrolysis was discontinued. Direct determination of the products in the electrolyzed mixture revealed: THF—OH: 66.4% CY, MY=85%; BL: 13.7% CY, MY=6%, SA in traces. The very slightly yellow electrolyte was worked up as in Example 1. 17.6 g of crude product were obtained. The specific platinum loss was again only 0.04 mg/Ah. (CY denotes the current yield and MY the material yield.)

EXAMPLE 3

In the cell of Example 1, 200 ml of the electrolyte mentioned in Example 1 were electrolyzed over a cylindrical (h=7 cm, ID=5 cm) titanium mesh anode (8 mesh holes/$cm^2$), which had been activated with $RuO_2$ (4 g of Ru/$m^2$, $RuO_2$:$TiO_2$=1:1), under the following conditions: current 17.9 A (anode surface area=228 $cm^2$, both sides together), current density 75 mA $cm^{-2}$, counterelectrode: axial V2A wire electrode, 1.5 mm ID, temperature 35° C.

The cell voltage was on average 7.0 V. After 27 minutes, corresponding to a theoretical current yield of 60%, the experiment was discontinued. Direct determination of the products in the electrolyzed mixture revealed: THF—OH: 3.5% CY; BL in traces; SA in traces. In this case, too, THF—OH was formed selectively, but only with a small current yield as a consequence of the small oxygen overvoltage across the electrode.

We claim:

1. A process for preparing a cyclic hemiacetal of the formula

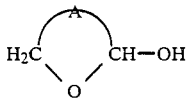

where A is saturated hydrocarbyl of 2 to 16 carbon atoms or an alkylether chain of 2 to 16 carbon atoms containing —O— as a bridge member, which comprises subjecting a cyclic ether of the formula

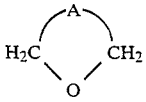

where A has the above-mentioned meaning, to anodic oxidation in aqueous solution at a current density of over 30 mA$cm^{-2}$ and recovering said hemiacetal as the predominant product.

2. A process as claimed in claim 1, wherein the electrolyte used is an aqueous acidic solution of the starting material.

3. A process as claimed in claim 1, wherein the electrolyte used contains sulfuric acid or phosphoric acid.

4. A process as claimed in claim 1, wherein electrolysis is effected at a current density of from over 30 to 1,000 mA $cm^{-2}$.

5. A process as claimed in claim 1, wherein electrolysis is effected at a current density of from 100 to 300 mA $cm^{-2}$.

6. A process as claimed in claim 1, wherein the anode material used is a metal or oxide of the platinum group.

7. A process as claimed in claim 1, carried out as a batch process wherein the conversion of the cyclic ether III is kept within the range of from 10 to 80%.

8. A process as claimed in claim 1, wherein the cyclic ether of the formula III is tetrahydrofuran, tetrahydropyran or 1,4-dioxane.

9. A process as claimed in claim 1, wherein the electrolysis is carried out at from 0° to 50° C.

10. A process as claimed in claim 7 wherein the conversion of the cyclic ether III is kept within the range of from 20 to 60%.

11. A process as claimed in claim 7 wherein A in the formulae I, II and III is selected from the group consisting of —$CH_2$—$CH_2$—, —$CH_2$—$CH_2$—$CH_2$— and —$CH_2$—O—$CH_2$—.

* * * * *

UNITED STATES PATENT AND TRADEMARK OFFICE

CERTIFICATE OF CORRECTION

PATENT NO. : 4,842,700

DATED : June 27, 1989

INVENTOR(S) : Beck et al

It is certified that error appears in the above-identified patent and that said Letters Patent is hereby corrected as shown below:

Abstract, line 1, delete "thereof".

Signed and Sealed this

Twenty-fourth Day of April, 1990

*Attest:*

HARRY F. MANBECK, JR.

*Attesting Officer*

*Commissioner of Patents and Trademarks*